US009089781B1

(12) United States Patent
Bush

(10) Patent No.: US 9,089,781 B1
(45) Date of Patent: Jul. 28, 2015

(54) COMBINATION MIRROR AND AMUSEMENT SYSTEM WITH MOBILE ASSEMBLY

(75) Inventor: Mary Jean Bush, Santa Rosa Beach, FL (US)

(73) Assignee: BRICA, Inc., Van Nuys, CA (US)

( * ) Notice: Subject to any disclaimer, the term of this patent is extended or adjusted under 35 U.S.C. 154(b) by 1266 days.

(21) Appl. No.: 11/796,616

(22) Filed: Apr. 27, 2007

(51) Int. Cl.
*A63G 33/00* (2006.01)

(52) U.S. Cl.
CPC ..... *A63G 33/00* (2013.01)

(58) Field of Classification Search
CPC ..... G02B 7/18; A63G 33/00
USPC ..... 446/227
See application file for complete search history.

(56) References Cited

U.S. PATENT DOCUMENTS

| | | | | |
|---|---|---|---|---|
| 3,038,060 | A | 6/1962 | Diehl | |
| 3,973,834 | A | 8/1976 | Penn et al. | |
| D280,997 | S * | 10/1985 | Thomson et al. | D21/59 |
| 4,712,892 | A | 12/1987 | Masucci | |
| 4,745,397 | A | 5/1988 | Lagerbauer et al. | |
| 4,746,919 | A | 5/1988 | Reitmeier | |
| 4,902,118 | A | 2/1990 | Harris | |
| 4,909,618 | A | 3/1990 | Gardner | |
| 4,973,286 | A | 11/1990 | Davison | |
| 4,978,207 | A | 12/1990 | Gillner et al. | |
| 4,984,380 | A | 1/1991 | Anderson | |
| 5,032,099 | A | 7/1991 | Chan | |
| 5,076,520 | A * | 12/1991 | Bro | 248/165 |
| 5,188,421 | A | 2/1993 | Arseneault | |
| 5,228,879 | A | 7/1993 | Fromm | |
| 5,310,377 | A | 5/1994 | Joja | |
| 5,453,915 | A | 9/1995 | Bradley, III | |
| 5,668,526 | A | 9/1997 | Collins | |
| 5,803,786 | A * | 9/1998 | McCormick | 446/227 |
| 6,030,085 | A * | 2/2000 | Leam et al. | 359/871 |
| 6,039,455 | A | 3/2000 | Sorenson | |
| 6,084,527 | A | 7/2000 | Spector | |
| 6,113,454 | A | 9/2000 | Mitchell | |
| 6,116,983 | A | 9/2000 | Long et al. | |
| 6,120,155 | A | 9/2000 | Brennan et al. | |
| 6,183,335 | B1 | 2/2001 | Petersen | |
| 6,305,810 | B1 | 10/2001 | Mercado | |
| 6,319,087 | B1 | 11/2001 | Ferrigno | |
| 6,354,708 | B1 | 3/2002 | Monahan et al. | |
| 6,367,875 | B1 * | 4/2002 | Bapst | 297/250.1 |
| 6,478,435 | B2 | 11/2002 | Monahan et al. | |
| 6,491,403 | B2 | 12/2002 | Edgar | |
| 6,554,437 | B2 | 4/2003 | von Glasgow | |
| 6,585,384 | B2 | 7/2003 | Nielsen et al. | |
| 6,736,694 | B2 | 5/2004 | Hornsby et al. | |
| 6,857,753 | B2 | 2/2005 | Kane | |
| 6,913,364 | B2 | 7/2005 | Kane | |
| 7,097,314 | B1 | 8/2006 | Darling | |
| 7,104,661 | B2 | 9/2006 | Kane et al. | |
| 2004/0266312 | A1 * | 12/2004 | Oren et al. | 446/227 |

* cited by examiner

*Primary Examiner* — Michael Dennis
(74) *Attorney, Agent, or Firm* — Robert Z. Evora

(57) ABSTRACT

A combination mirror and amusement system, including a mirror assembly having a mirror and a mirror housing, and a mobile assembly attached to the mirror housing above the mirror. A sound generator may be included, along with a timer that may be set by a user to control the length of time the sound generator generates sound. The system may be used inside a vehicle for observing an infant in a rear facing car seat.

10 Claims, 4 Drawing Sheets

COMBINATION MIRROR AND AMUSEMENT SYSTEM WITH MOBILE ASSEMBLY

BACKGROUND OF THE INVENTION

The invention relates to mirrors used inside a vehicle primarily for observing an infant in a rear facing car seat secured to the rear seat of a motor vehicle. Such mirrors may alternatively serve primarily as a source of entertainment and amusement for a child in a forward-facing car seat secured to the rear seat of a motor vehicle.

Mirror devices of the general type described are disclosed, for example, in Kane U.S. Pat. Nos. 6,857,753 and 6,913,364; Kane et al U.S. Pat. No. 7,104,661; and Darling U.S. Pat. No. 7,097,314

Very briefly, in such devices, a mirror is mounted or attached near the top of the rear seat of a motor vehicle in such a way that the driver of the vehicle, by looking in the rear view mirror, can observe an infant in a safety seat of the type in which the infant is positioned facing the rear of the vehicle. The mirror may alternatively be mounted or attached near the top of the front seat of a motor vehicle to function primarily as a source of entertainment and amusement for a child in a forward-facing car seat secured to the rear seat of a motor vehicle.

SUMMARY OF THE INVENTION

In one aspect, a combination mirror and amusement system is provided which includes a mirror assembly comprising a mirror housing, and a mobile assembly attached to the mirror housing.

In another aspect, a combination mirror and amusement system is provided which includes a mirror assembly comprising a mirror housing, a sound generator, and a timer that may be set by a user of the system to control the length of time the sound generator is generating sound; and a mobile assembly attached to the mirror housing.

DETAILED DESCRIPTION

Figure 1:
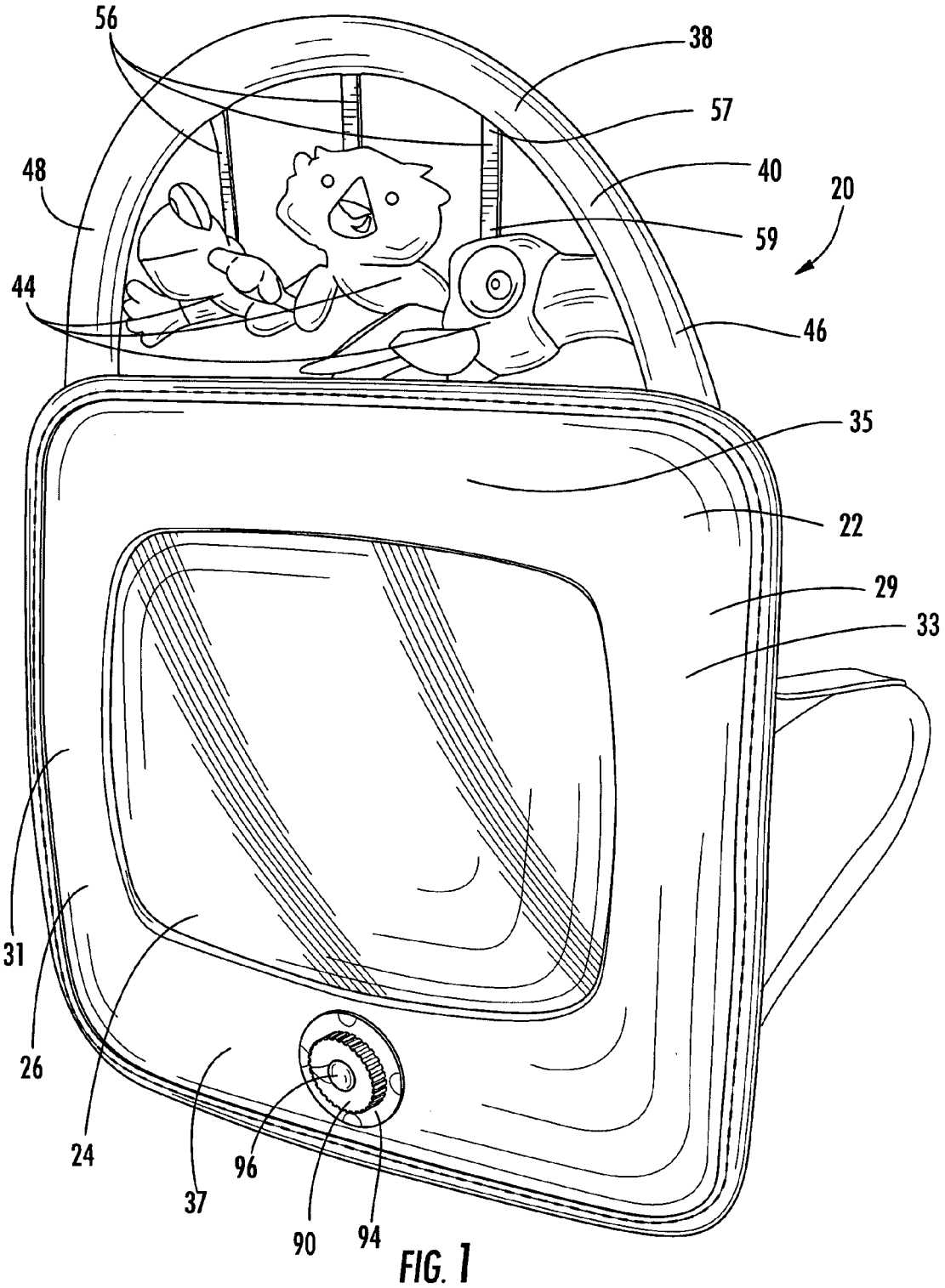
FIG. 1 is a generally anterior perspective view of a combination mirror and amusement system in accordance with an embodiment of the invention.
Figure 2:
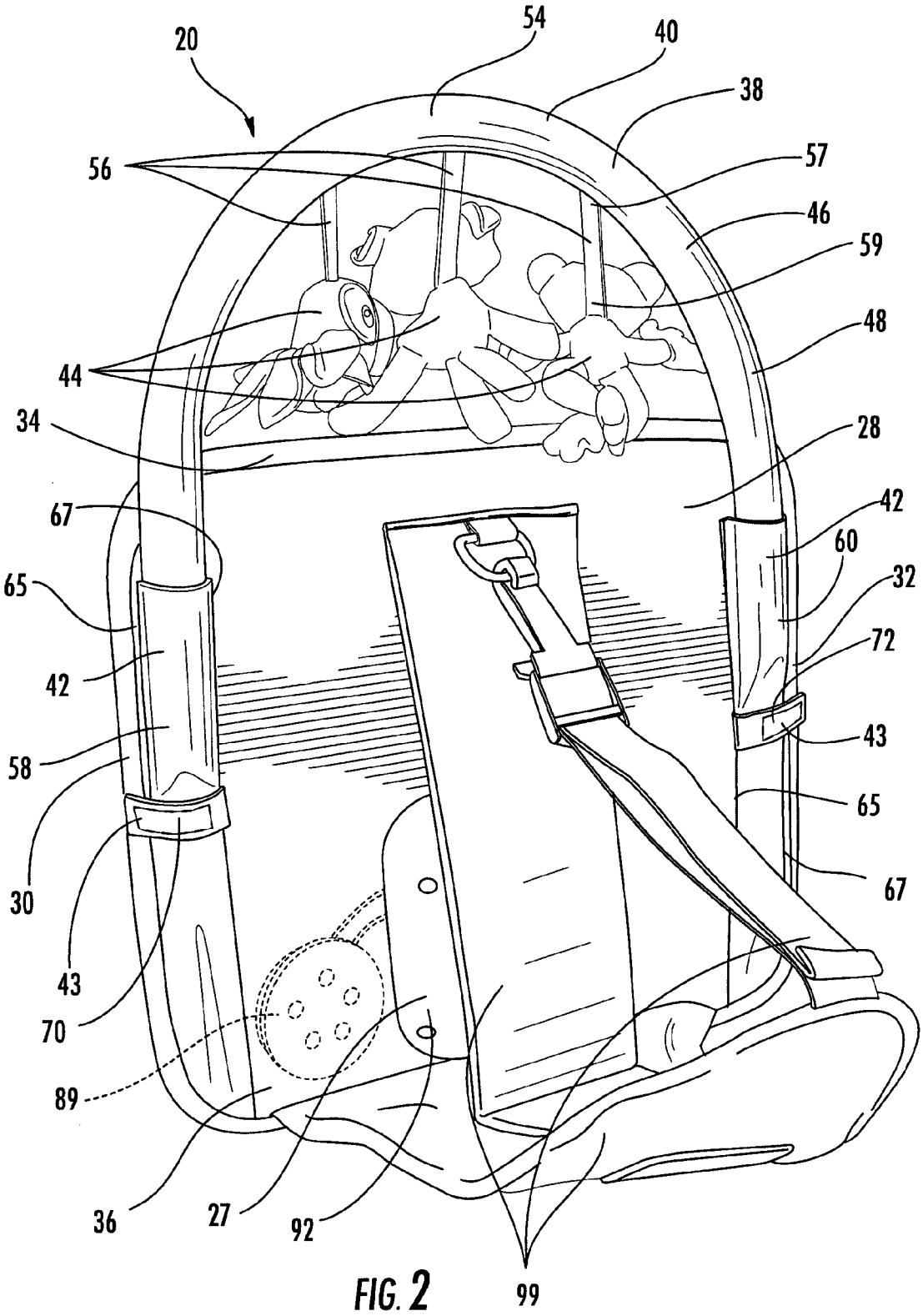
FIG. 2 is a generally posterior perspective view of the combination mirror and amusement system shown in FIG. 1.
Figure 3:
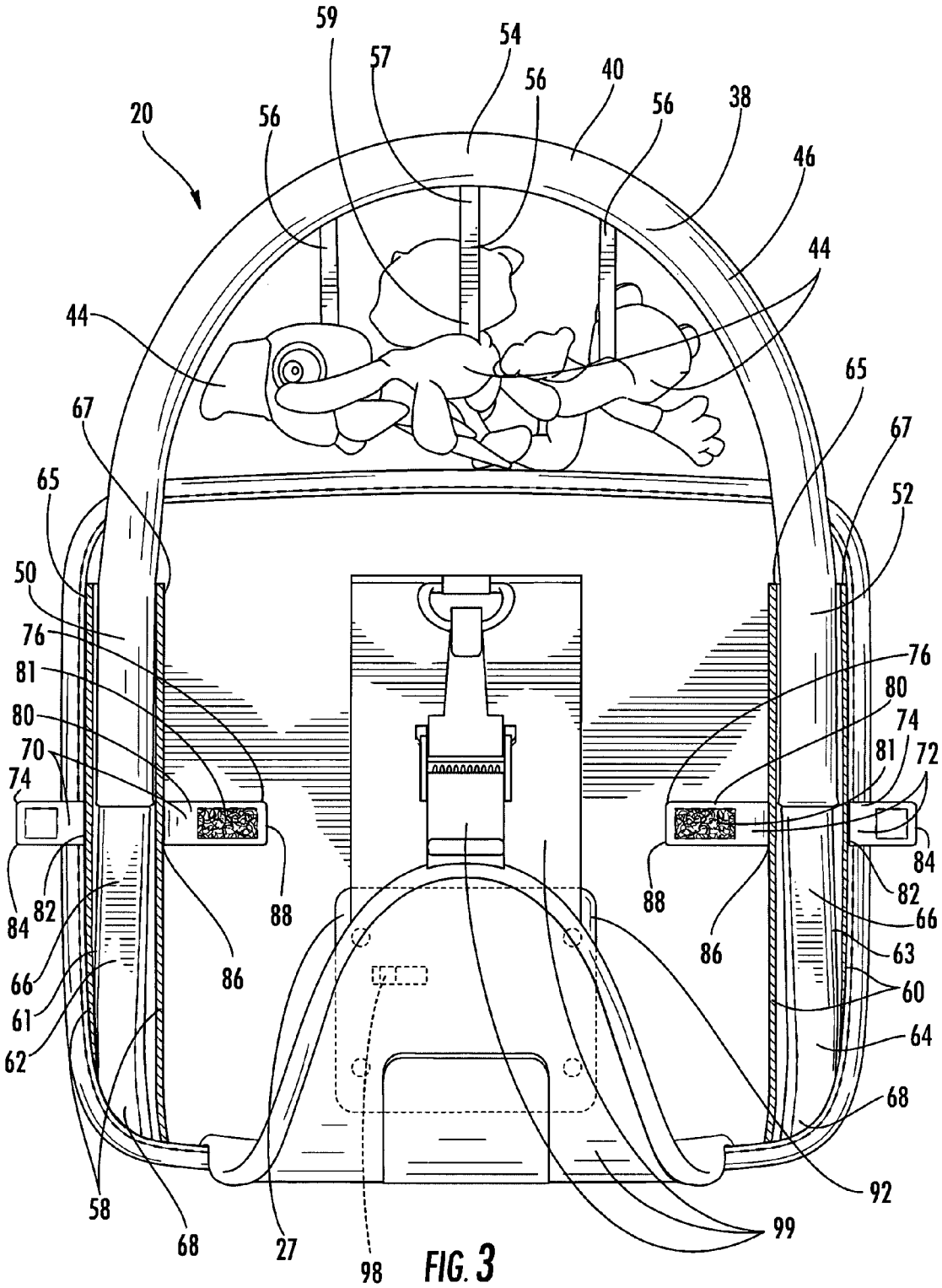
FIG. 3 is a posterior elevational view of the combination mirror and amusement system shown in FIG. 1, with the sleeve panels (58, 60) substantially cut away.

A combination mirror and amusement system is shown broadly in FIGS. 1, 2, and 3 at reference numeral 20.

The system 20 includes a mirror assembly 22 that comprises a mirror 24, a mirror housing 26, a sound generation system 27 (FIG. 2), and a mirror assembly attachment system 99. The mirror housing 26 includes a front fabric frame 29 comprising first and second opposing vertical portions 31, 33 and first and second opposing horizontal portions 35, 37. The mirror housing 26 further includes a rear fabric panel 28 (FIG. 2) comprising first and second opposing vertical edge portions 30, 32 and first and second opposing horizontal edge portions 34, 36. Mirror assembly attachment systems, suitable for the mirror assembly attachment system 99, are for example, disclosed in Kane U.S. Pat. Nos. 6,857,753 and 6,913,364, the entire disclosures of which are hereby expressly incorporated by reference. It will be appreciated that other attachment systems may be utilized to attach the mirror assembly 22 to a seat of a motor vehicle in accordance with the knowledge of those of ordinary skill in the art.

The system further includes a mobile assembly 38 attached to the mirror housing 26. As used herein, a structure may be "attached" to another structure by sewing, fastening, adhering, or any other method that brings the two structures into substantially secure contact with one another. The mobile assembly 38 comprises a mobile 40, a mobile attachment system 42, and a mobile support system 43. The mobile 40 includes a hanger 46 attached to the mirror housing 26 by the mobile attachment system 42 and a plurality of toys 44 suspended from the hanger 46. Specifically, the hanger 46 comprises an arch 48 having first and second opposing end portions 50, 52 (FIG. 3) and a middle portion 54 between the first and second end portions 50, 52. The toys 44 are each suspended from the middle portion 54 of the arch 48 by a toy tether 56 in order to dangle freely from the middle portion 54 of the arch 48 when the system 20 is installed. Each toy tether 56 comprises first and second ends 57, 59. The first end 57 of each toy tether 56 is attached to the middle portion of the arch 48, while the second end 59 of each toy tether 56 is attached to one of the toys 44.

The mobile attachment system 42 includes first and second sleeve panels 58, 60 attached to the first and second vertical edge portions 30, 32 of the rear fabric panel 28 of the mirror housing 26 to form first and second sleeves 61, 63 (FIG. 3) with the mirror housing 26. The first and second sleeve panels 58, 60 each comprise first and second longitudinal edges 65, 67 oriented in substantially parallel relation to the first and second vertical edge portions 30, 32 of the rear fabric panel 28 of the mirror housing 26. Alternatively, fully formed sleeves (not shown) may be attached to the rear fabric panel 28 of the mirror housing 26. In addition, the sleeves may be formed on or attached to portions of the mirror housing 26 other than the rear fabric panel 28. As shown in FIG. 3, in which the sleeve panels 58, 60 have been substantially cut away for illustration purposes, the mobile attachment system 42 further includes first and second hanger tethers 62, 64, each comprising first and second ends 66, 68. The first end 66 of the first hanger tether 62 is attached to the first end portion 50 of the arch 48, while the first end 66 of the second hanger tether 64 is attached to the second end portion 52 of the arch 48. The second ends 68 of the hanger tethers 62, 64 are each attached to the second horizontal edge portion 36 of the mirror housing 26.

The mobile support system 43 (FIGS. 2 and 3) includes first and second tab pairs 70, 72 attached to the rear fabric panel 28 of the mirror housing 26. Each of the tab pairs 70, 72 comprises a first tab 74 and a second tab 76 (FIG. 3). The first and second tabs 74, 76 in each of the tab pairs 70, 72 are configured to be attached to one another such that they may easily be repeatedly detached from and reattached to one another. In the disclosed embodiment, an outward-facing surface (not shown) of each of the first tabs 74 is provided with a panel of hooks (not shown, but stitching is visible on inward-facing surface) of a hook-and-loop fastening system known to those of ordinary skill in the art, while inward-facing surfaces 80 of the second tabs 76 are provided with a panel of loops 81 corresponding to the panel of hooks.

Each of the first tabs 74 includes an attached end 82 and a free end 84. The attached end 82 of the first tab 74 of the first tab pair 70 is attached to the first vertical edge portion 30 of the rear fabric panel 28 of the mirror housing 26 at a location adjacent to the first longitudinal edge 65 of the first sleeve panel 58 and slightly above the approximate longitudinal center of the first sleeve 61. Similarly, the attached end 82 of the first tab 74 of the second tab pair 72 is attached to the second vertical edge portion 32 of the rear fabric panel 28 of the mirror housing 25 at a location adjacent to the second longitudinal edge 67 of the second sleeve panel 60 and slightly above the approximate longitudinal center of the second sleeve 63.

Each of the second tabs 76 also includes an attached end 86 and a free end 88. The attached end 82 of the second tab 76 of the first tab pair 70 is attached to the rear fabric panel 28 of the mirror housing 26 at a location adjacent to the second longitudinal edge 67 of the first sleeve panel 58 and in substantial alignment with the first tab 74 of the first tab pair 70. Similarly, the attached end 82 of the second tab 76 of the second tab pair 72 is attached to the rear fabric panel 28 of the mirror housing 26 at a location adjacent to the first longitudinal edge 65 of the second sleeve panel 60 and in substantial alignment with the first tab 74 of the second tab pair 72.

The mobile support system 43 may be used in the following manner. During installation of the system 10, the hanger 46 is pulled out of the sleeves 61, 63 into a substantially fully extended position, thereby extending the hanger tethers 62, 64 to be substantially taut and allowing the toys 44 to dangle between the hanger 46 and the first horizontal edge portion 34 of the rear fabric panel 28 of the mirror housing 26. The second tabs 76 of the tab pairs 70, 72 are then folded over and attached to the corresponding first tabs 74 to substantially close the sleeves 61, 63 immediately below the end portions 50, 52 of the arch 48 of the substantially fully extended hanger 46. In this configuration, the tab pairs 70, 72 help prevent the hanger 46 from sliding back into the sleeves 61, 63 during use of the system 10 and rendering the mobile 40 substantially inaccessible and/or unusable.

Figure 4:
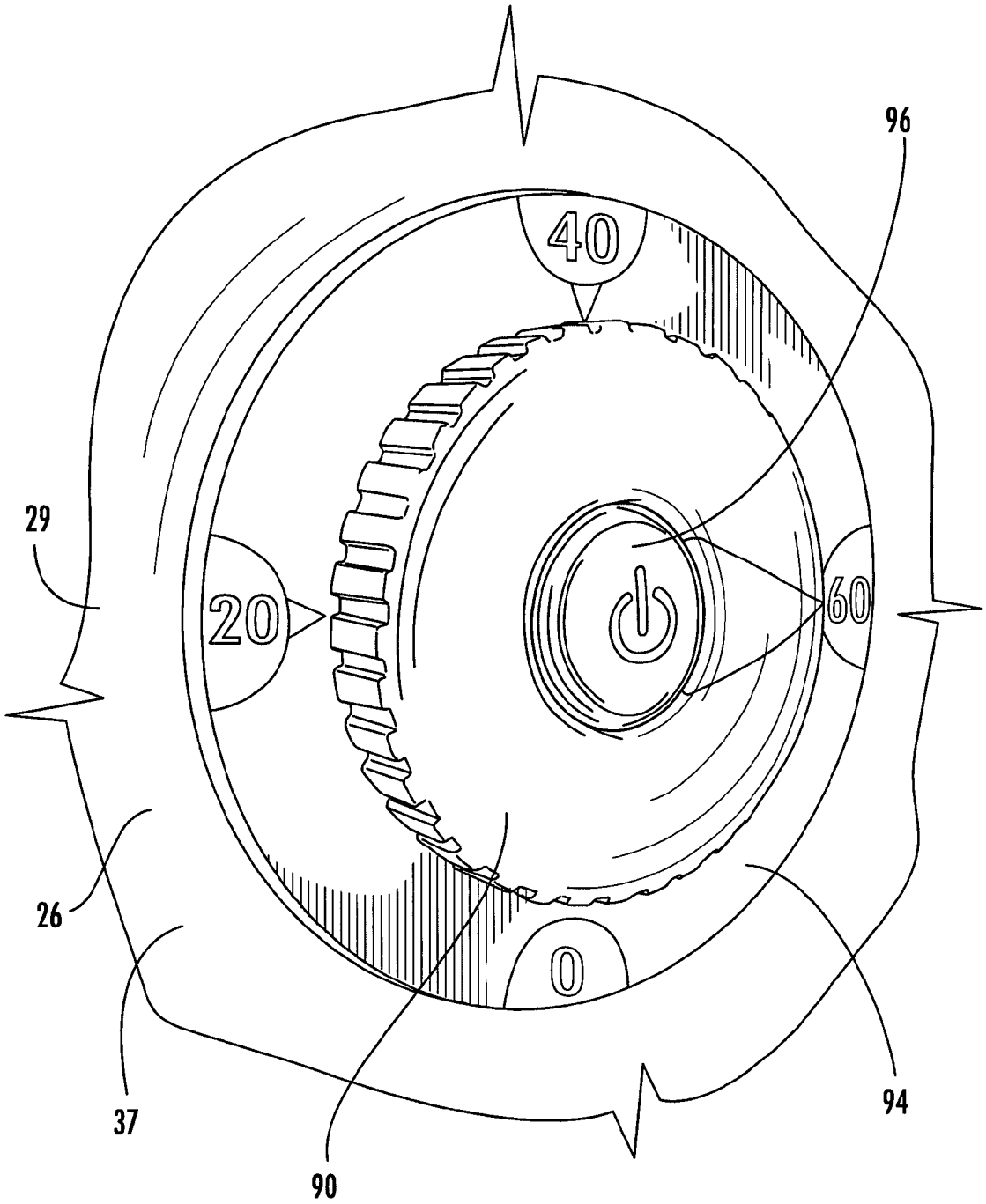
FIG. 4 is a detail view of the timer control dial and the timer setting indicator shown in FIG. 1.

The sound generation system 27 (FIGS. 2 and 3) of the mirror assembly 22 comprises a sound generator (not shown), sound generator control circuitry (not shown), and a loudspeaker 89 (FIG. 2), and a timer comprising a timer control dial 90 (FIGS. 1 and 4) and timer circuitry (not shown). The sound generator, the sound generator control circuitry, and the timer circuitry are housed within an electronics housing 92 attached to the rear fabric panel 28 of the mirror housing 26, while the loudspeaker 89 is housed within the mirror housing 26 adjacent to the second longitudinal edge 67 of the first sleeve panel 58 and the second horizontal edge portion 36 of the mirror housing 26.

The timer control dial 90 is attached to the second horizontal portion 37 of the front fabric frame 29 of the mirror housing 26. The timer control dial 90 has four detented settings, one each for zero (0), twenty (20), forty (40), and sixty (60) minutes. These settings are delineated by an annular timer setting indicator 94 oriented concentrically with the timer control dial 90. Specifically, the detents of the timer control dial 90 and the corresponding readings on the timer setting indicator 94 are configured such that the zero-, twenty-, forty-, and sixty-minute settings are oriented at positions substantially corresponding with six o'clock, nine o'clock, twelve o'clock, and three o'clock settings on a traditional analog timepiece. A timer start/stop button 96 is oriented substantially in the center of the timer control dial 90. Alternatively, any type of on/off switch may be utilized instead of the start/stop button 96.

The sound generation system 27 is configured such that the sound generator generates sound only when the timer is running. The timer is configured to begin running when the start/stop button 96 is pressed while the sound generator is not generating sound and to cease running when the start/stop button 96 is pressed while the sound generator is generating sound. Thus, the sound generator begins to generate sound when the start/stop button 96 is pressed while the sound generator is not generating sound and the sound generator ceases to generate sound when either (1) the timer runs out, or (2) the start/stop button 96 is pressed while the sound generator is generating sound. As long as the timer and the sound generator are not stopped prematurely by pressing the start/stop button 96 while the sound generator is generating sound, the timer runs and the sound generator generates sound for a period of time approximately equal to the period of time indicated on the timer setting indicator 94. If the start/stop button 96 is pressed while the timer control dial 90 is set to the zero-minute setting, the sound generator does not generate sound. If the timer control dial 90 is turned to the zero-minute setting while the sound generator is generating sound, the sound generator ceases to generate sound.

A sound generator mode switch 98 (FIG. 3; shown in phantom) is provided on the electronics housing 92. The sound generator mode switch 98 is a two-position toggle switch having a normal position and a display position. When the mode switch 98 is in the normal position, the timer and the sound generator operate as described above. When the mode switch 98 is in the display position, the sound generator only generates sound for approximately ten seconds, and only when (1) the timer control dial 90 is not in the zero-minute position, and (2) the start/stop button 96 is pressed. Even in the display position, if the start/stop button 96 is pressed or the timer control dial 90 is turned to the zero-minute position while the sound generator is generating sound, the sound generator ceases to generate sound.

The following materials are used in the fabrication of the disclosed embodiment of the invention; different materials may be substituted without departing from the scope of the invention. The arch 48 is a flexible cylinder of closed cell plastic foam inside a fabric tube, the sleeve panels 58, 60 are strips of thin fabric, and each of the toy tethers 56 and the hanger tethers 62, 64 is a pair of fabric strips sewn together. The electronics housing 92 is a hard plastic housing. The front fabric frame 29 is decorated with fanciful, child-appropriate images of various animals and plants that generally evoke a common theme. The toys 44 are small, stuffed pillows formed in the shapes of fanciful animals that evoke generally the same theme as the images on the front fabric frame 29. Finally, the sound generated by the sound generator includes music and sound effects that further evoke the same theme as the toys 44 and the images on the front fabric frame 29.

While specific embodiments of the invention have been illustrated and described herein, numerous modifications and changes will occur to those skilled in the art. It is therefore to be understood that the appended claims are intended to cover all such modifications and changes as fall within the true spirit and scope of the invention.

What is claimed is:

1. A combination mirror and amusement system, comprising:

a mirror assembly comprising a mirror and a mirror housing;

a mirror assembly attachment system for attaching said mirror assembly near the top of the rear seat of a motor vehicle or a mirror assembly attachment system for attaching said mirror assembly near the top of the front seat of the motor vehicle;

a mobile assembly attached to and structurally supported by a mobile attachment system having first and second sleeves partially formed by the mirror housing to support the mobile assembly above the mirror; and first and second hanger tethers disposed inside the first and second sleeves and extend lengthwise along an inside of the first and second sleeves, respectively, wherein each of the hanger tethers comprises first and second ends and the first ends of the hanger tethers are attached to the mirror housing.

2. The system of claim 1, wherein the mobile assembly comprises a mobile.

3. The system of claim 2, wherein the mobile comprises:

a hanger attached to the mirror housing by the mobile attachment system, and a plurality of toys suspended from the hanger.

4. The system of claim 3, wherein the hanger comprises an arch comprising first and second opposing end portions and a middle portion between the first and second end portions.

5. The system of claim 3, wherein:

the hanger comprises an arch comprising first and second opposing end portions and a middle portion between the first and second end portions, wherein the first and second end portions of the arch are inside the first and second sleeves, respectively, and the second ends of the first and second hanger tethers are attached to the first and second end portions of the arch, respectively.

6. A combination mirror and amusement system, comprising:

a mirror assembly comprising a mirror and a mirror housing, a sound generator, and a timer that may be set by a user of the system to control the length of time the sound generator is generating sound;

a mirror assembly attachment system for attaching said mirror assembly near the top of the rear seat of a motor vehicle or a mirror assembly attachment system for attaching said mirror assembly near the top of the front seat of the motor vehicle; and a mobile assembly attached to a mobile attachment system having first and second sleeves partially formed in the mirror housing, and structurally supported by the mirror housing above the mirror wherein the mobile assembly further comprises a mobile system having first and second hanger tethers disposed inside the first and second sleeves and extend lengthwise along an inside of the first and second sleeves, respectively, wherein each of the hanger tethers comprises first and second ends and the first ends of the hanger tethers are attached to the mirror housing.

7. The system of claim 6, wherein the mirror assembly further comprises a switch for selectably starting and stopping the timer and thereby activating and deactivating the sound generator.

8. The system of claim 6, wherein the mobile comprises:

a hanger attached to the mirror housing by the mobile attachment system, and a plurality of toys suspended from the hanger.

9. The system of claim 8, wherein the hanger comprises an arch comprising first and second opposing end portions and a middle portion between the first and second end portions.

10. The system of claim 8, wherein the hanger comprises an arch comprising first and second opposing end portions and a middle portion between the first and second end portions, wherein the first and second end portions of the arch are inside the first and second sleeves, respectively, and the second ends of the first and second tethers are attached to the first and second end portions of the arch, respectively.

* * * * *